US007246834B2

(12) United States Patent
Cheng

(10) Patent No.: US 7,246,834 B2
(45) Date of Patent: Jul. 24, 2007

(54) CUSHION PAD STRUCTURE FOR A CARPET INSTALLATION TOOL

(75) Inventor: Yuan-Ching Cheng, Taichung (TW)

(73) Assignee: Allied Arrows Associates Co., Ltd. (TW)

( * ) Notice: Subject to any disclaimer, the term of this patent is extended or adjusted under 35 U.S.C. 154(b) by 0 days.

(21) Appl. No.: 11/335,664

(22) Filed: Jan. 20, 2006

(65) Prior Publication Data

US 2007/0114805 A1 May 24, 2007

(51) Int. Cl.
*A47G 27/04* (2006.01)

(52) U.S. Cl. ..... 294/8.6; 254/200

(58) Field of Classification Search ..... 294/8.6; 267/94, 117; 254/200, 201; 297/DIG. 1
See application file for complete search history.

(56) References Cited

U.S. PATENT DOCUMENTS 3,547,479 A * 12/1970 Tasse ..... 294/8.6
3,572,800 A * 3/1971 Graziano ..... 294/8.6
5,190,328 A * 3/1993 Anderson ..... 294/8.6
5,294,181 A * 3/1994 Rose et al. ..... 297/452.25
6,371,562 B1 * 4/2002 Yoshimura et al. .... 297/452.61

* cited by examiner

*Primary Examiner*—Dean J. Kramer
(74) *Attorney, Agent, or Firm*—Bacon & Thomas PLLC

(57) ABSTRACT

The cushion pad structure of the carpet installation tool comprises a rubber covering layer, a rubber foam body and an assembly board. The foam body is disposed in the covering layer. The foam body comprises a thrust face, which has a plurality of the first holes with at least a predetermined depth. The thrust face is designed so that a technician's knee or heel receives less reaction force from the impulse imparted due to the plurality of the first holes and softened hardness. Under the impulse force, the hardness of the advance gradually cushioning structure increases its hardness slowly and generates a maximum hardness at a proper position that may be experimentally determined, efficiently transferring the maximum impulse force to the carpet installation tool. The carpet installation tool therefore provides protection for the technician's knee and ankle joints, and efficiently transfers the impulse force.

20 Claims, 5 Drawing Sheets

CUSHION PAD STRUCTURE FOR A CARPET INSTALLATION TOOL

BACKGROUND OF THE INVENTION

1. Field of the Invention

The present invention relates to a cushion pad structure for an installation tool, and more particularly, to a cushion pad structure for a carpet installation tool.

2. Description of the Related Art

Generally, carpets or rugs lying on a floor need to be tightened and smoothed over the surface of the floor, and should not exhibit wrinkles or raised so as to avoid trip and fall type accidents or injuries.

Additionally, many carpets and rugs present pattern matching problems, which may arise from the pattern in the carpet or rug itself, or with another pattern in the environment, such as patterns on walls or furniture appear uncoordinated. However, while it is sometimes impossible to re-install the entire carpet, it may be possible to make sectional adjustments.

When carpet installation is being performed along the edges of the walls or in corners, since the technician is standing on the carpet, he or she is unable to pull on the carpet, and so a carpet installation tool is utilized to finish the installation.

The carpet installation tool is used to perform sectional adjustments, or to assist with installation along the edges of walls and in corner sections. Therefore, such carpet installation tools are very important for completing carpet installation. Carpet installation tools also have the additional advantages of being small sized, light in weight, portable, reasonably priced, etc., and so are very popular.

Please refer to FIG. 1. FIG. 1 shows a prior art carpet installation tool in use. As shown in the drawing, a carpet installation tool 9 comprises a cushion pad 95, a connecting arm 92 and a claw disk 94. One end of the connecting arm 92 is connected to the cushion pad 95, and another end is connected to the claw disk 94. The claw disk 94 has a plurality of claws 941 that are turned down and forward. The claws 941 are used for digging into the lower layer of the carpet 82 and grabbing the surface layer of the carpet 82 to enhance the traction between the carpet installation tool 9 and the carpet 82. In usage of the carpet installation tool 9, as shown in FIG. 1, a technician needs to get down on one or both knees to use the knee 81 to push upon the cushion pad 95; consequently, the impulse force is transferred to the claw disk 94 via the connecting arm 92, and the claws 941 apply the force to the carpet 82. Of course, the technician may also stand and kick the cushion pad 95 with his or her heel to achieve the same results.

Installation using the carpet installation tool completely relies on the impulse force from the technician's knee or heel. However, this impulse force must sometimes be as high as 3000 NT, which is equal to the weight of 4 to 5 adults. Additional, the carpet installation tool may be used very frequently by the technician, which might cause temporary or sustained or even permanent chronic injury to the knee or ankle joints of the technician. According to the statistics research from the U.S. NIOSH (National Institute for Occupational Safety and Health) department, the odds of a technician in this field having a knee or ankle injury is 108 times higher than for other people, and the actual number might even be significantly higher than this. Therefore, there are many technicians in this field that have stopped working because of injuries to knee or ankle joints.

To protect knee and ankle joints of a technician, and to efficiently transfer the impulse force, the hardness of the cushion pad must be carefully calculated to provide an optimum balance. Softer cushion pads provide better protection for knee and ankle joints, but do not efficiently transfer the impulse force; on the other hand, harder cushion pads directly and efficiently transfer the impulse force, but they also create larger reaction forces to knee and ankle joints, which cause unnecessary injury.

In the prior art, most of the inside layer of the cushion pad of the carpet installation tool is made of natural rubber, or other suitable plastic material, which is a single material that may be a foam or some other material type, and used as the main buffering structure for the impulse force; the inside layer is covered with a harder rubber.

It is desirable to provide a cushion pad structure for an installation tool to mitigate and/or obviate the aforementioned problems.

SUMMARY OF THE INVENTION

The present invention provides a cushion pad structure for a carpet installation tool, the carpet installation tool comprises: a connecting arm and a claw disk, one end of the connecting arm has the cushion pad structure, another end of the connecting arm has the claw disk, and the claw disk faces downwards and having a plurality of claws.

The cushion pad structure of the carpet installation tool comprises a covering layer, a foam body and an assembly board. The covering layer has a containment space and an opening. The foam body is disposed in the containment space of the covering layer, the foam body comprises an assembly face and a thrust face respectively disposed on two opposite side faces of the foam body, the assembly face faces the opening of the covering layer, the thrust face has a plurality of the first holes with at least a predetermined depth. The assembly plate disposed in the containment space of the covering layer, the assembly plate is disposed between the covering layer and the assembly face of the foam body. The assembly plate is mounted on one end of the connecting arm.

The thrust face is designed so that a technician's knee or heel receives less reaction force from the impulse imparted by the technician's knee joint or ankle joint due to the plurality of the first holes and softened hardness. Under the impulse force, the hardness of the advance gradually cushioning structure increases its hardness slowly and generates a maximum hardness at a proper position that may be experimentally determined, efficiently transferring the maximum impulse force to the carpet installation tool and reducing to a minimum the loss of the impulse force. The carpet installation tool therefore provides protection for the technician's knee and ankle joints, and efficiently transfers the impulse force.

The first holes can be tapered holes, columnar holes, prismatic holes or other equvial holes, which can be various designs.

Furthermore, the thrust face of the foam body further comprises a plurality of second holes having a second predetermined depth; the predetermined depth of the second holes is not equal to the first predetermined depth of the first holes. Therefore, the present invention utilizes the different depths of the second holes and the first holes, which may more accurately adjust the hardness of the foam body. The necessity and number of second holes may be determined based on the hardness requirements of the foam body.

Furthermore, the thrust face of the foam body further comprises a plurality of second holes with a second predetermined depth, and the diameter of the second holes is larger than the diameter of the first holes. Therefore, the present invention utilizes the different diameters of the second holes and the first holes to more accurately adjust the hardness of the foam body.

The second holes can be tapered holes, columnar holes, prismatic holes or other equvial holes, which can be decided for various designs.

The connecting arm further comprises a front arm and a rear arm, and the rear arm is slidable into the front arm. Therefore, the user can adjust the length of the connecting arm.

The foam body can be a rubber foam body, a plastic foam body or other equvial foam body, which can be decided for various designs.

The assembly board can be an aluminum plate, an iron plate, an alloy plate or other equvial plate, which can be decided for various designs.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
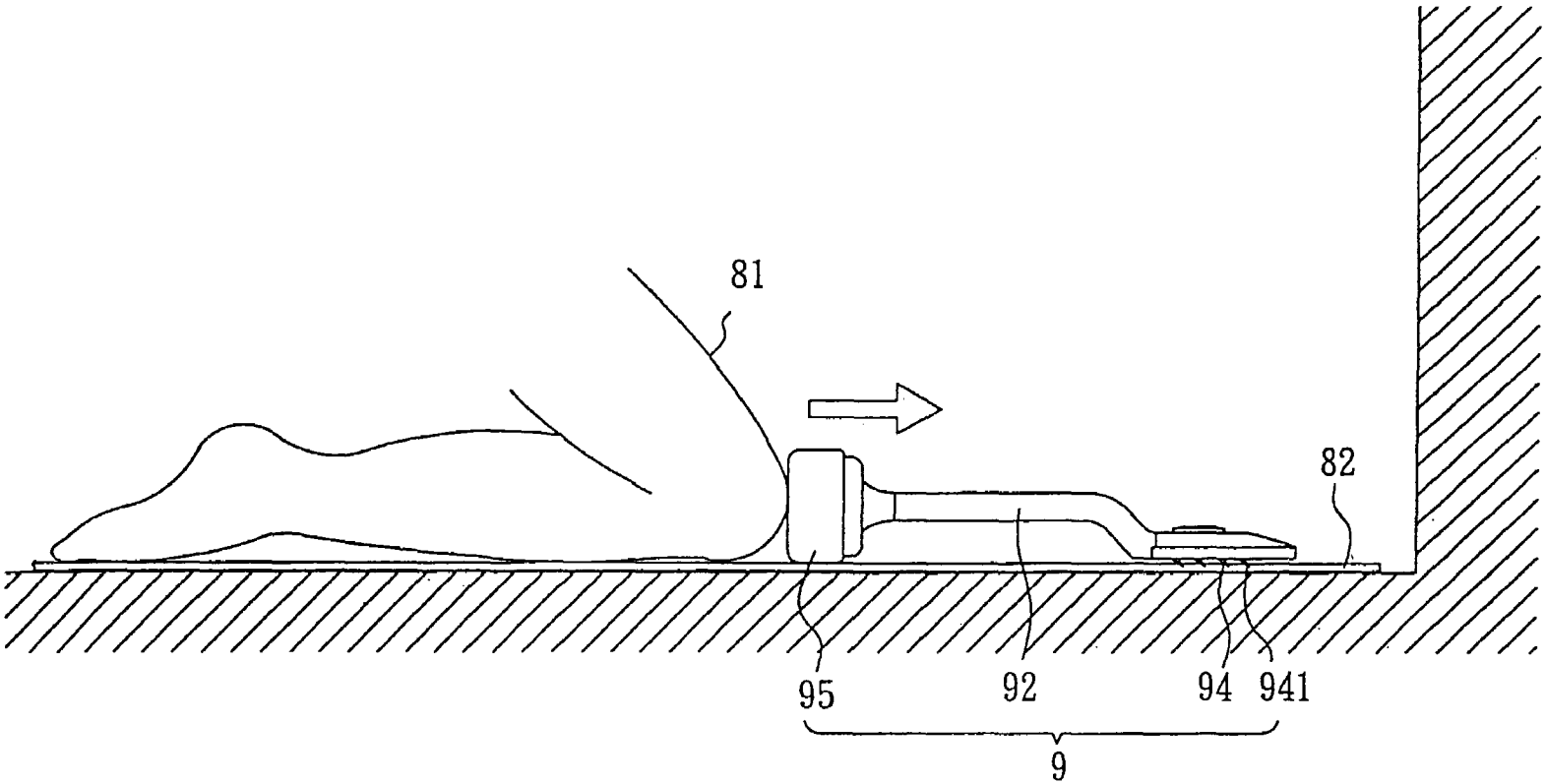
FIG 1 (Prior Art)
FIG. 1 shows a prior art carpet installation tool in use.
Figure 2:
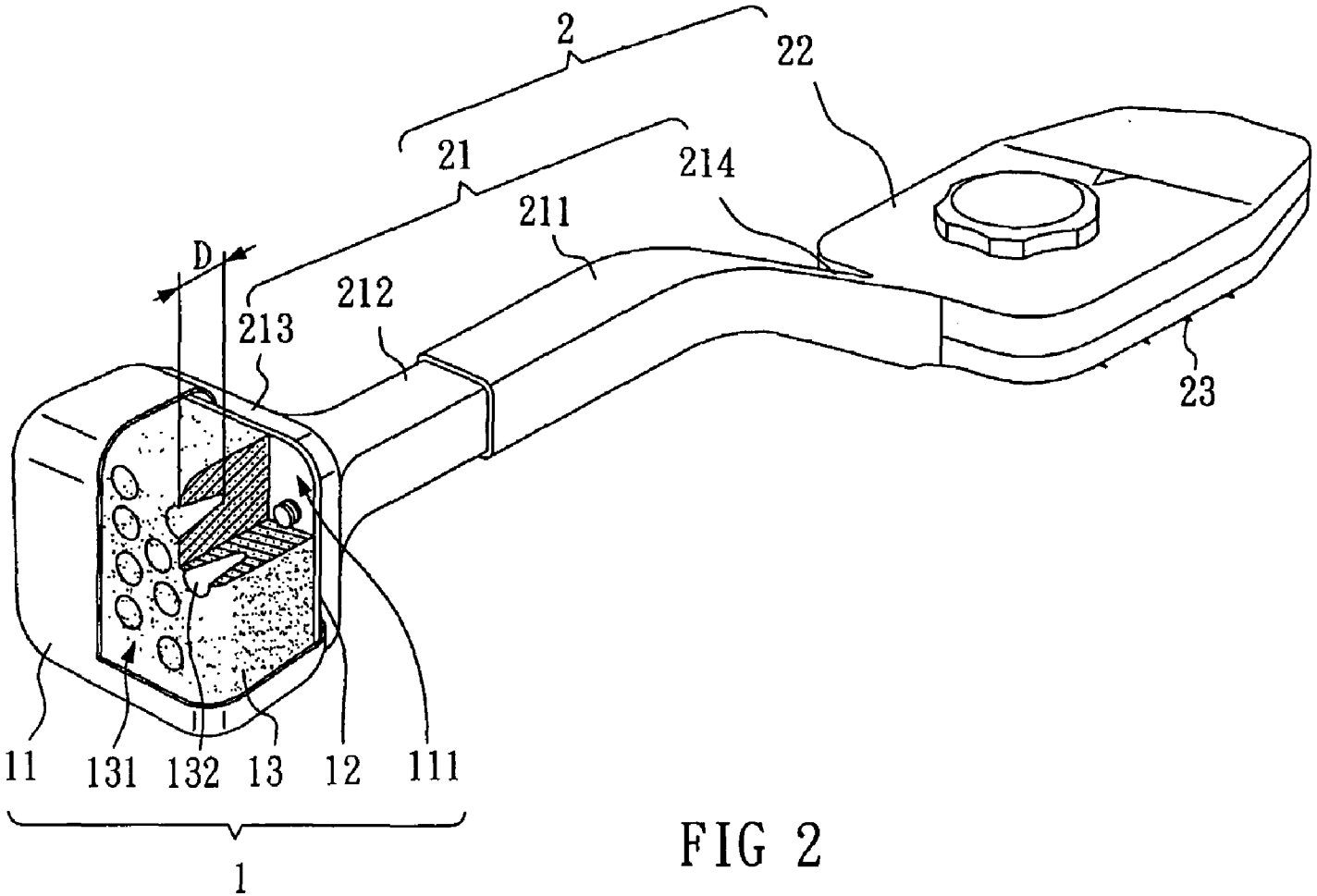
FIG. 2 is a perspective view with a partial cross-sectional view of a first embodiment of the present invention.
Figure 3:
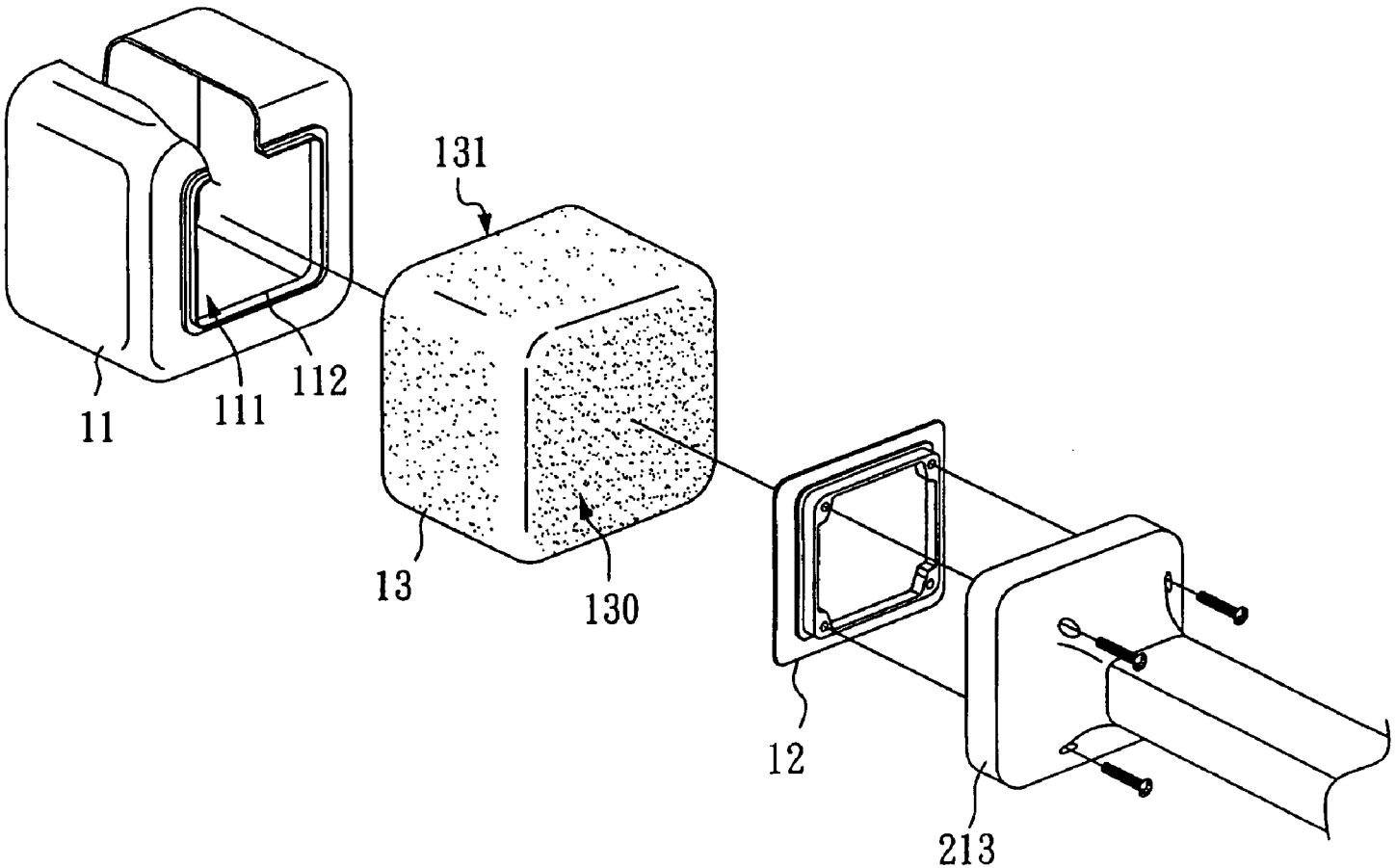
FIG. 3 is a partial exploded view of the first embodiment of the present invention.

Please refer to FIG. 2 and FIG. 3. FIG. 2 provides a perspective view of a first embodiment of the present invention. FIG. 3 is a local exploded view of the first embodiment of the present invention. As shown in FIG. 2, a cushion pad 1 of the present invention is mounted at the rear end of a carpet installation tool 2.

The carpet installation tool 2 comprises a connecting arm 21 and a claw disk 22. As shown in FIG. 2, the connecting arm 21 comprises a front arm 211 and a rear arm 212. One end 214 of the front arm 211 is connected to the claw disk 22, and the claw disk 22 has a plurality of claws 23 extending down and forward (only four claws 23 are shown in the drawing due to the viewing angle). The rear arm 212 is disposed in the front arm 211 so that the length of the connecting arm 21 can be adjusted by the technician. One end 213 of the rear arm 212 is a locking end, which has a cushion pad 1.

As shown in FIG. 2, the cushion pad 1 comprises a covering layer 11, an assembly plate 12 and a foam body 13. The covering layer 11 comprises a containment space 111, and an opening 112 (as shown in FIG. 3). In this embodiment, the covering layer 11 is a rubber covering layer, but the covering layer can also be made of other suitable elastic materials. The foam body 13 is disposed in the containment space 111 of the covering layer 11. In this embodiment, the foam body 13 is a rubber foam body; similarly, the foam body 13 may also be made for other suitable elastic materials. As shown in FIG. 2 and FIG. 3, the foam body 13 comprises an assembly face 130 and a thrust face 131, which are disposed along two opposite faces of the foam body 13. The assembly face 130 of the foam body 13 faces the opening 112 of the covering layer 11 (as shown in FIG. 3), and the thrust face 131 of the foam body 13 may have nine first holes 132 (as shown in FIG. 2). In this embodiment, the first holes 132 are tapered holes having a first predetermined depth D. The assembly plate 12 is disposed in the containment space 111 of the covering layer 11 between the covering layer 11 and the assembly face 130 of the foam body 13, and the assembly plate 12 is mounted on one end 213 of the connecting arm 212. In this embodiment, the assembly plate 12 is an aluminum plate, but may also be made from other suitable hard or rigid materials.

The foam body 13 utilizes the first holes 132 on the thrust face 131 to form an advance gradually cushioning structure. The thrust face 131 is designed so that a technician's knee or heel receives less reaction force from the impulse imparted by the technician's knee joint or ankle joint due to the plurality of the first holes 132 and softened hardness. Under the impulse force, the hardness of the advance gradually cushioning structure increases its hardness slowly and generates a maximum hardness at a proper position that may be experimentally determined, efficiently transferring the maximum impulse force to the carpet installation tool 2 and reducing to a minimum the loss of the impulse force. The carpet installation tool therefore provides protection for the technician's knee and ankle joints, and efficiently transfers the impulse force.

Figure 4:
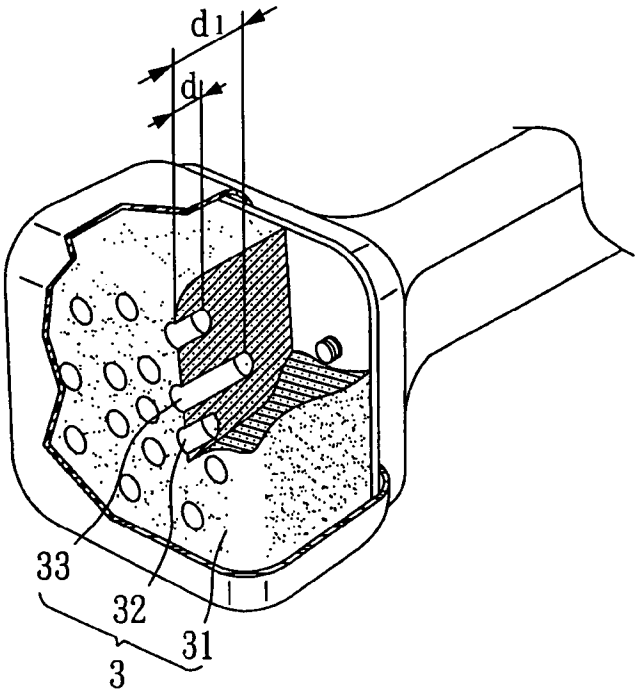
FIG. 4 is a partial cross-sectional view of a second embodiment of the present invention.

Please refer to FIG. 4. FIG. 4 is a local cross-sectional view of a second embodiment of the present invention. As shown in FIG. 4, the second embodiment is similar to the first embodiment, but the foam body 3 is changed. In this embodiment, the thrust face 31 of the foam body 3 further comprises five second holes 33 having a second predetermined depth dl; the predetermined depth dl of the second holes 33 is longer than the first predetermined depth d of the first holes 32. In this embodiment, the first holes 32 and the second holes 33 are all columnar holes. Therefore, this embodiment utilizes the different depths of the second holes 33 and the first holes 32, which may more accurately adjust the hardness of the foam body 3 to achieve the benefits described in the first embodiment. The necessity and number of second holes 33 may be determined based on the hardness requirements of the foam body 3.

Figure 5:
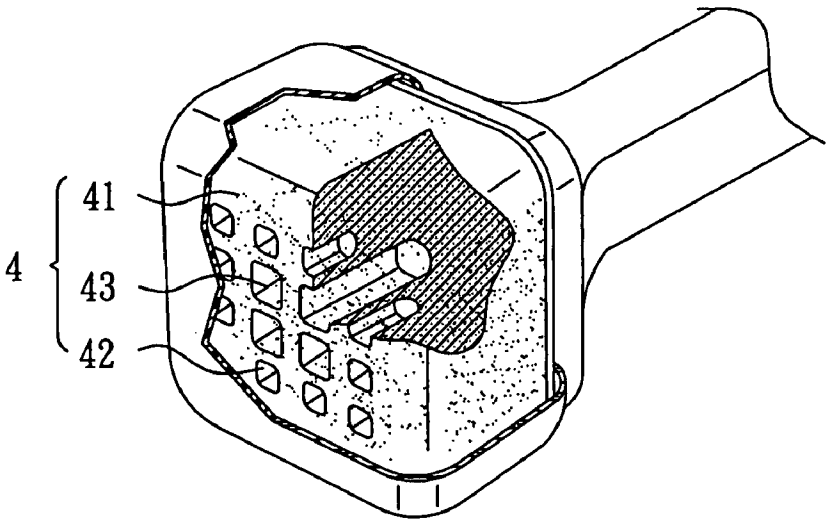
FIG. 5 is a partial cross-sectional view of a third embodiment of the present invention.

Please refer to FIG. 5. FIG. 5 is a local cross-sectional view of a third embodiment of the present invention. As shown in FIG. 5, the third embodiment is similar to the first embodiment, but with changes to the foam body 4. In this embodiment, the thrust face 41 of the foam body 4 further comprises four second holes 43 with a second predetermined specific depth, and the diameter of the second holes 43 is larger than the diameter of the first holes 42. In this embodiment, the first holes 42 and the second holes 43 are all prismatic holes. Therefore, this embodiment utilizes the different diameters of the second holes 43 and the first holes 42 to more accurately adjust the hardness of the foam body 4 and achieve the benefits mentioned in the first embodiment. The necessity and number of second holes 43 may be determined based on the hardness requirements of the foam body 4.

Although the present invention has been explained in relation to its preferred embodiment, it is to be understood that many other possible modifications and variations can be made without departing from the spirit and scope of the invention as hereinafter claimed.

What is claimed is:

1. A cushion pad structure for a carpet installation tool, the carpet installation tool comprising:

a connecting arm and a claw disk, one end of the connecting arm mounting the cushion pad structure, another end of the connecting arm mounting the claw disk, the claw disk facing downwards and having a plurality of claws; the cushion pad structure for the carpet installation tool comprising:

a covering layer having a containment space and an opening;

a foam body disposed in the containment space of the covering layer, the foam body comprising an assembly face and a thrust face respectively disposed on two opposite side faces of the foam body, the assembly face facing the opening of the covering layer, the thrust face having a plurality of first holes with at least a predetermined depth, the first holes being tapered holes; and an assembly plate disposed in the containment space of the covering layer, the assembly plate disposed between the covering layer and the assembly face of the foam body, the assembly plate mounted on one end of the connecting arm.

2. The cushion pad structure for a carpet installation tool as claimed in claim 1, wherein the thrust face of the foam body has a plurality of second holes having another predetermined depth not equal to the predetermined depth of the first holes.

3. The cushion pad structure for a carpet installation tool as claimed in claim 2, wherein the second holes are tapered holes.

4. The cushion pad structure for a carpet installation tool as claimed in claim 2, wherein the second holes are columnar holes.

5. The cushion pad structure for a carpet installation tool as claimed in claim 2, wherein the second holes are prismatic holes.

6. The cushion pad structure for a carpet installation tool as claimed in claim 1, wherein the thrust face of the foam body has a plurality of second holes having another predetermined depth, and the diameter of the second holes is not equal to the diameter of the first holes.

7. The cushion pad structure for a carpet installation tool as claimed in claim 1, wherein the connecting arm further comprises a front arm and a rear arm, the rear arm is slidable into the front arm.

8. The cushion pad structure for a carpet installation tool as claimed in claim 1, wherein one end of the connecting arm is a locking end.

9. The cushion pad structure for a carpet installation tool as claimed in claim 8, wherein the assembly plate locks at the lock end of the connecting arm.

10. The cushion pad structure for a carpet installation tool as claimed in claim 1, wherein the foam body is a foam rubber body.

11. The cushion pad structure for a carpet installation tool as claimed in claim 1, wherein the covering layer is a rubber covering layer.

12. The cushion pad structure for a carpet installation tool as claimed in claim 1, wherein the assembly plate is an aluminum plate.

13. A cushion pad structure for a carpet installation tool, the carpet installation tool comprising:

a connecting arm and a claw disk, one end of the connecting arm mounting the cushion pad structure, another end of the connecting arm mounting the claw disk, the claw disk facing downwards and having a plurality of claws; the cushion pad structure for the carpet installation tool comprising:

a covering layer having a containment space and an opening;

a foam body disposed in the containment space of the covering layer, the foam body comprising an assembly face and a thrust face respectively disposed on two opposite side faces of the foam body, the assembly face facing the opening of the covering layer, the thrust face having a plurality of first holes with at least a predetermined depth, the first holes being prismatic holes; and an assembly plate disposed in the containment space of the covering layer, the assembly plate disposed between the covering layer and the assembly face of the foam body, the assembly plate mounted on one end of the connecting arm.

14. The cushion pad structure for a carpet installation tool as claimed in claim 13, wherein the thrust face of the foam body has a plurality of second holes having another predetermined depth not equal to the predetermined depth of the first holes.

15. The cushion pad structure for a carpet installation tool as claimed in claim 14, wherein the second holes are tapered holes.

16. The cushion pad structure for a carpet installation tool as claimed in claim 14, wherein the second holes are columnar holes.

17. The cushion pad structure for a carpet installation tool as claimed in claim 14, wherein the second holes are prismatic holes.

18. The cushion pad structure for a carpet installation tool as claimed in claim 13, wherein the thrust face of the foam body has a plurality of second holes having another predetermined depth, and the diameter of the second holes is not equal to the diameter of the first holes.

19. The cushion pad structure for a carpet installation tool as claimed in claim 13, wherein the foam body is a foam rubber body.

20. The cushion pad structure for a carpet installation tool as claimed in claim 13, wherein the covering layer is a rubber covering layer.

* * * * *